United States Patent [19]

Genini

[11] 4,040,454

[45] Aug. 9, 1977

[54] DRAWING GRIPPER FOR GRIPPING AND TRANSPORTING WEFT YARNS IN CONTINUOUS WEFT FEED LOOMS

[75] Inventor: Graziano Genini, Stabio, Switzerland

[73] Assignee: Albatex A.G., Vaduz, Liechtenstein

[21] Appl. No.: 616,059

[22] Filed: Sept. 23, 1975

[30] Foreign Application Priority Data

Sept. 23, 1974 Switzerland ..... 12832/74
Sept. 11, 1975 Switzerland ..... 11805/75

[51] Int. Cl.[2] ..... D03D 47/22
[52] U.S. Cl. ..... 139/448
[58] Field of Search ..... 139/122 R, 122 N, 123, 139/125, 127 R, 447, 448, 196.2

[56] References Cited

U.S. PATENT DOCUMENTS

| | | | |
|---|---|---|---|
| 3,532,136 | 10/1970 | Golobart | 139/122 |
| 3,578,031 | 5/1971 | Maassen | 139/122 |
| 3,613,741 | 10/1971 | Ravella | 139/448 |
| 3,861,427 | 1/1975 | Scheidecker | 139/448 |
| 3,901,284 | 8/1975 | Riolet | 139/122 |
| 3,927,699 | 12/1975 | Volpe | 139/448 |

*Primary Examiner*—Henry S. Jaudon
*Attorney, Agent, or Firm*—Young & Thompson

[57] ABSTRACT

A drawing gripper for gripping and transporting weft yarns in continuous weft feed looms, which draws the weft thread from the carrying gripper at the center of the shed and transports the same out of the shed, said drawing gripper comprising a fixed member carried by a support connected to the means for moving forward the gripper itself, and a movable member, oscillating in respect of the fixed member about a vertical axis, in a horizontal plane parallel to that containing said fixed member. This latter is provided with a hook end extending in a vertical plane, with the inner upper part of which cooperates the end of the movable member, under the action of return spring means.

3 Claims, 20 Drawing Figures

Fig. 1
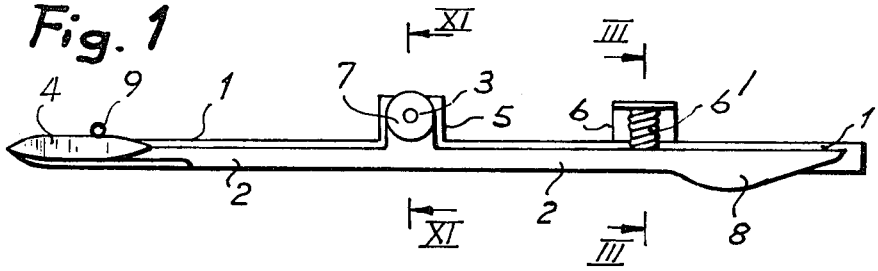
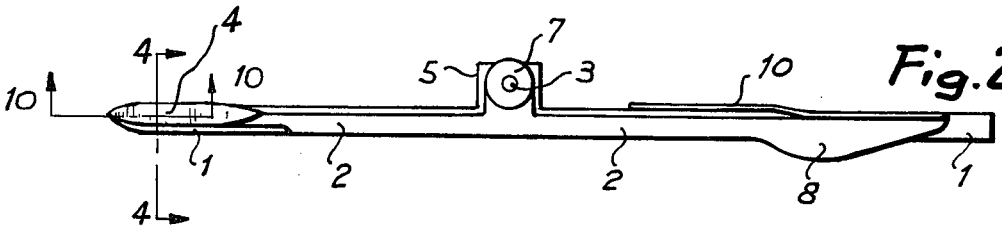
Fig. 2
Fig. 4
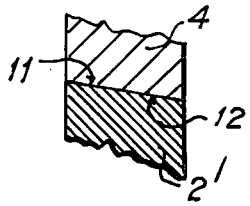
Fig. 5
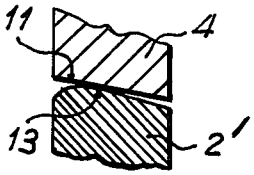
Fig. 3
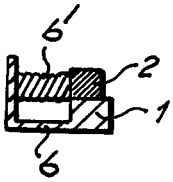
Fig. 6
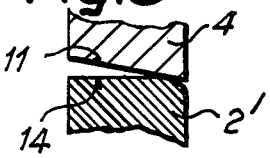
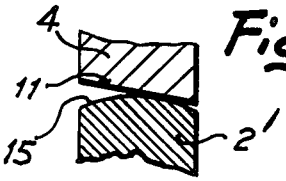
Fig. 7
Fig. 10
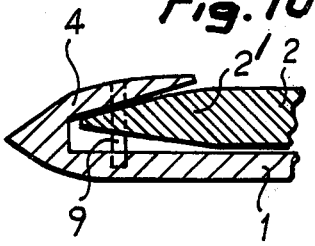
Fig. 8
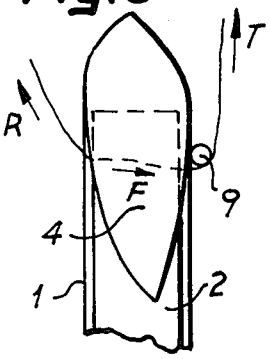
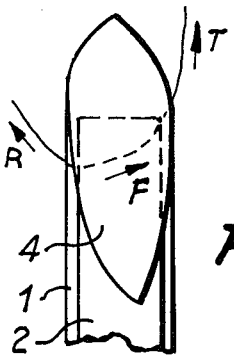
Fig. 9

Fig. 11
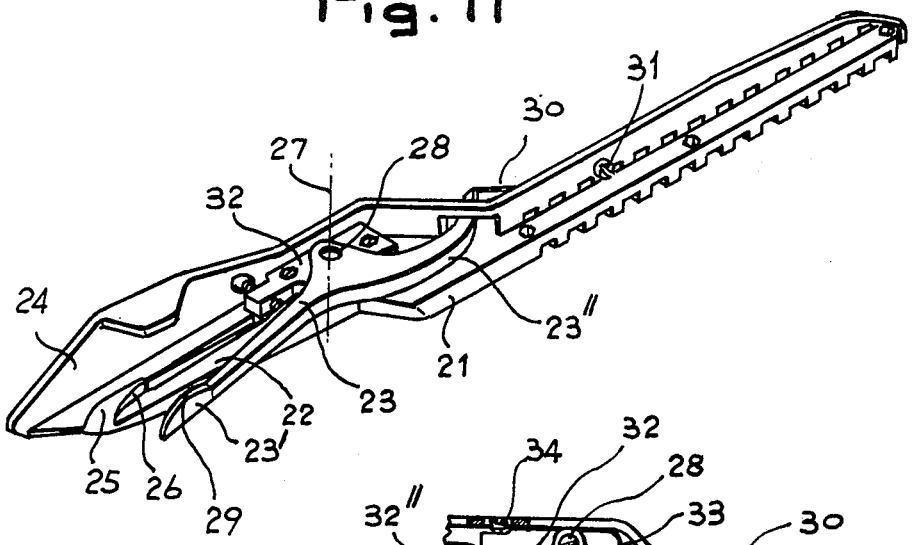
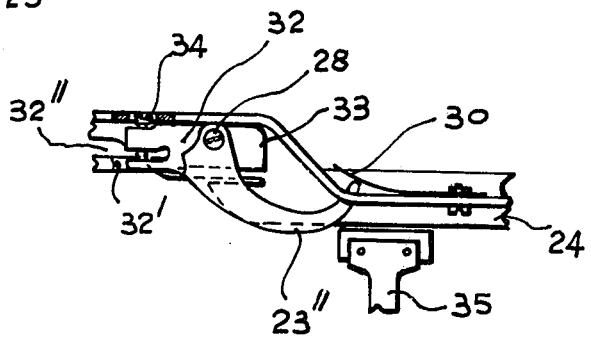
Fig. 12

Fig. 13
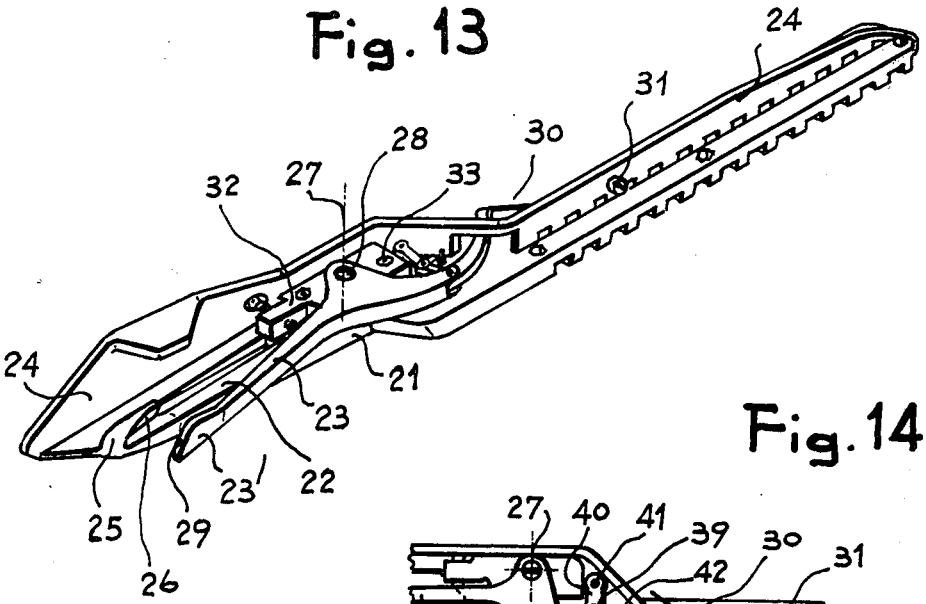
Fig. 14
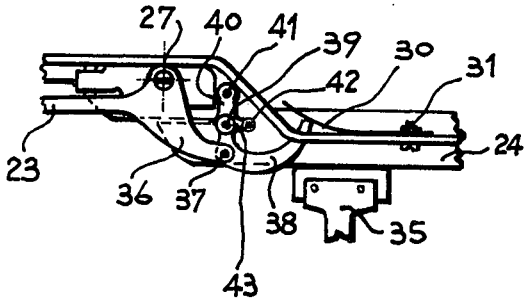
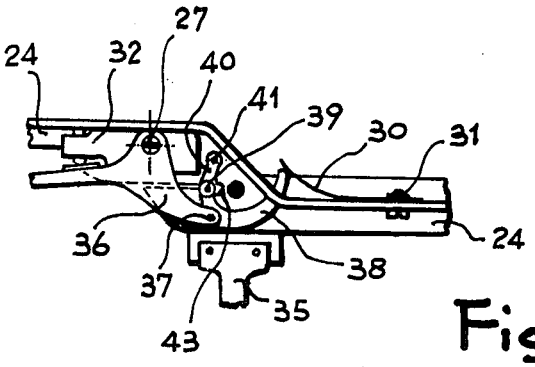
Fig. 15

DRAWING GRIPPER FOR GRIPPING AND TRANSPORTING WEFT YARNS IN CONTINUOUS WEFT FEED LOOMS

BACKGROUND OF THE INVENTION

The present invention relates to a gripper, with highly efficient gripping power, for gripping and transporting weft threads through the shed in continuous weft feed looms.

The gripper according to the invention is a "drawing" gripper, namely a gripper designed to grasp the weft thread about half way through the shed, withdrawing it from a companion "carrying" gripper which has carried it thereto, and draw said thread up to the end of the loom opposite to the feeding end.

Generally, such drawing grippers have been made up to the present with a fixed lower member and with a movable upper hook-shaped member, adapted to oscillate in a vertical plane in respect of the fixed member. Grippers of this type insert themselves in the companion carrying-type grippers, from which the upper hook member draws the weft thread holding it, for its transport, between said upper member and the fixed lower member. The movable hook-shaped member is generally pivoted on a horizontal axis, perpendicular to the longitudinal direction of the gripper, and is pressed by spring means against the fixed member.

Although the conventional drawing grippers work in a fairly satisfactory way, they have some drawbacks concerning the safety in gripping the weft thread, at the moment of drawing the same from the carrying gripper, and concerning the gripping efficiency during subsequent transport of said thread. It is hence desirable to produce grippers which may prevent such drawbacks and improve the performance of looms equipped therewith.

SUMMARY OF THE INVENTION

The object of the present invention is to supply an improved drawing gripper for gripping and transporting weft threads, wherein the movable member is mounted for oscillation in respect of the fixed member about a vertical axis, in a horizontal plane parallel to that containing said fixed member, this latter being provided with a hook end, with the inner part of which cooperates the end of the movable member, under the action of the return spring means.

In a first embodiment of the invention, the cooperation between the fixed member and the movable member takes place in correspondence of the upper surface of the end of the movable member and in correspondence of the inner upper surface of the hook part of the fixed member: the end of the movable member is then usually beveled, to adapt itself to the inner surface, also beveled, of the hook of the fixed member; these two surfaces may have an equal or a different configuration.

In a second and preferred embodiment of the invention, the end of the movable member and the hook part of the fixed member, designed to cooperate one with the other, are formed as conjugated helical surfaces with variable pitch.

The best results are obtained by forming the conjugated helical surfaces in such a way that, when they get close to contact, the mutual distance and the inclination in respect to the horizontal plane of the actual surfaces, decrease towards the end of the gripper.

BRIEF DESCRIPTION OF THE DRAWINGS

The invention will now be described in further detail with reference to the two cited embodiments thereof, and to some modifications of the same, shown in the accompanying drawings, wherein:

FIG. 1 is a somewhat diagrammatic plan view with parts omitted for simplicity, of the gripper according to the invention in a first embodiment thereof;

FIG. 2 shows in similarly simplified form a modification of the gripper embodiment of FIG. 1;

FIG. 3 is a section view on the line III—III of FIG. 1, illustrating a detail of the return spring means of the gripper;

FIGS. 4 to 7 are cross sections through the hook of the gripper of FIGS. 1 or 2, taken on the line 4—4 of FIG. 2, to show various suitable configurations of the cooperating surfaces of the gripper members;

FIGS. 8 and 9 are enlarged fragmentary top plan views and show the behaviour of the weft thread during operation, according to whether one adopts the embodiment of FIG. 1 or of FIG. 2, of the gripper according to the invention;

FIG. 10 is a longitudinal section through the hook of the gripper according to the invention, taken on the line 10—10 of FIG. 2;

FIG. 11 is a perspective view of a second embodiment of the gripper according to the invention;

FIG. 12 shows a plan view of a detail of mounting the movable member and the means for adjusting the closing position of the same, in the gripper of FIG. 11;

FIG. 13 is a perspective view of a first modification of the second embodiment of the gripper according to the invention;

FIG. 14 is a plan view, similar to that of FIG. 12, showing a detail of the gripper of FIG. 13, with the movable member in a closed position;

FIG. 15 is a plan view showing a detail, as in FIG. 14, with the movable member in an open position;

DESCRIPTION OF THE PREFERRED EMBODIMENTS

Figure 16:
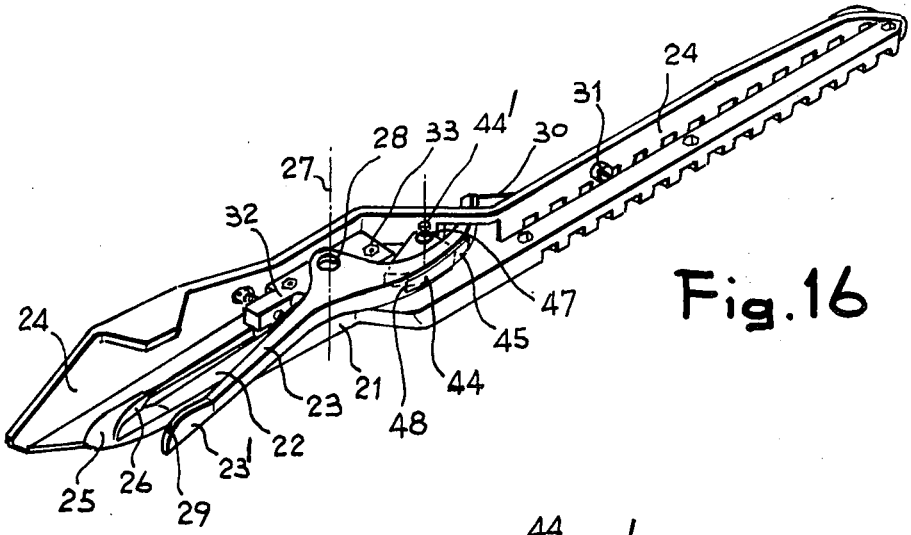
FIG. 16 is a perspective view of a second modification of the second embodiment of the gripper according to the invention.
Figure 17:
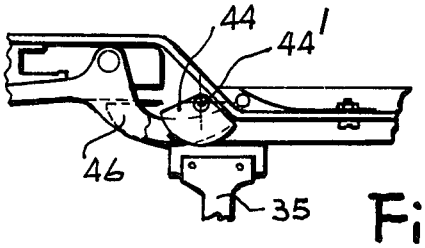
FIG. 17 is a plan view, similar to those of FIGS. 12, 14 and 15, showing a detail of the gripper of FIG. 16.

With reference to FIG. 1, it may be seen that the gripper according to the invention comprises a first lower fixed member 1 and a second movable member 2, being pivoted on the first about the vertical axis 3. The gripper member 1 will be supported by a base, preferably of plastic material, not shown, the characteristics of which may be those of similar components in conventional grippers. Said member 1 terminates at the end of the gripper in a hook 4, arranged in a vertical plane and clearly shown in FIG. 10. Said member 1 is further provided with two lateral supports integral therewith, of which, an intermediate support 5 carries the pivot 3 for oscillating the movable member 2, and a rear support 6 houses the return spring means for the movable member 2.

The movable 2 is formed as an elongated bar, being beveled at the front end 2', widened at the centre with an ear 7 for pivoting on the pivot 3, and thickened at the rear end into a cam projection 8.

The pivoting between the ear 7 and the pivot 3 may be obtained by means of a bearing (preferably a small needle bearing) or by using a pair of aligned and opposed pointed screws, between the points of which is rotatably arranged the ear 7.

The cam projection 8 is designed to cooperate with a tappet of the loom, for releasing the weft thread, as explained hereinafter.

A pin or threadguide 9 may be provided, secured vertically on one side of the hook 4.

Between the lateral support 6 of the fixed member 1 and the side of the movable member 2 facing said support, are arranged return spring means, comprising — in the case of FIGS. 1 and 3 — a helical cylindrical spring 6', designed to press the front end of the movable member 2 into contact with the inner upper surface of the hook 4 of the fixed member.

In the modification shown in FIG. 2 (drawn also without the threadguide 9) the lateral support 6 is missing, in that the return spring means interposed between the two members of the gripper, consists of a flat spring 10, fixed to the side of the member 1 and acting also laterally on the member 2, as clearly shown in FIG. 2.

As will have been understood from the already given description, in using the gripper according to the invention, the weft thread carried by the carrying gripper will be grasped by the hook 4 and held between the inner upper surface of said hook and the corresponding upper surface of the end of the movable member 2. For thread engagement, the shape of the two surfaces gripping the thread is of some importance. Said shape varies according to the type of thread to be transported and to the kind of work to be performed. The accompanying drawing shows various interesting combinations of such surfaces shapes.

The inner surface 11 of the hook 4 has always been shown as a flat inclined surface, while the corresponding upper surface of the end of the movable member 2 is: in the case of FIG. 4, a flat surface 12 being inclined exactly like the surface 11; in the case of FIG. 5, a flat surface 13 being more inclined than the surface 11 and with a rounded outlet edge; in the case of FIG. 6, a flat horizontal surface 14 with a rounded inlet edge; and in the case of FIG. 7, a substantially cylindrical surface 15.

It is understood that other shapes of the surface 11 and of the corresponding surface of the end of the member 2, may be provided and combined.

In use, the gripper according to the invention is pushed, with its own front part comprising the hook 4, into the carrying gripper, and is then caused to move backward, after that the weft thread stretched through the carrying gripper has gone over the hook 4, said thread being arranged transversely to said hook. At this point, as can be seen from FIGS. 8 or 9, the weft thread penetrates between the hook 4 and the end of the oscillating member 2 cooperating with said hook. The insertion of the thread takes place extremely smoothly and easily, since initially, the traction acting on the thread is that produced by the resistance of the means locking the thread in the carrying gripper: said traction acts according to the arrow R and tends to open the gripper, that is, to cause the member 2 to oscillate towards the left, in FIGS. 8 or 9. At once after the thread has abandoned with its end in the carrying gripper, the traction acting thereon is that produced by the resistance to the advancement of the thread by the feeding reels or similar devices: said traction acts according to the arrow T and tends to close the gripper, that is, to cause the lower member of the gripper to oscillate towards the right, in FIGS. 8 or 9. It thus happens that the insertion of the thread is very safely performed, avoiding the risk — which is always present in the known grippers — that the thread itself may be rejected by the hook, and on the other hand, the gripping of the thread between the claws during transport takes place just as safely, said claws acting at this stage as self-locking, hence preventing the risk of a thread loss in the shed. The self-locking effect may be increased by using the threadguide consisting of the pin 9: in fact, by comparing FIGS. 8 and 9, it may easily be seen that the force F, which tends to produce the closing of the gripper, acts — in the case of FIG. 8 — almost transversely to the gripper and has, therefore, the highest self-locking effect, while — in the case of FIG. 9 — (the pin 9 being absent) only a component of said force will be acting to favour the closing of the gripper. The self-locking effect obtained thereby, allows one to considerably reduce — compared to the known devices — the intensity of the force produced by the springs 6' or 10.

It is understood that the gripper is normally pressed towards the closing position by the spring means 6' or 10, which are released only upon freeing of the weft thread, once the gripper has come out of the shed, at the end opposite to the feeding end. For this purpose — as has been said — a tappet, for example in the form of a block fixed to the loom, acts on the cam projection 8, to cause the rotation of the oscillating claw 2, so as to carry the end thereof outwardly and out of engagement from the hook 4. It is understood that said tappet or block may be adjustable, to suit the opening of the gripper to the type of yarn being used.

Considering now the second embodiment, shown in the drawings, of the drawing gripper according to the invention, let us examine first of all the FIGS. 11 and 12: therein, the drawing gripper consists of a basic body 21, the rear part of which may be connected to a strap or rod for controlling the gripper itself (not shown), and the front part of which carries the fixed member 22 and the movable member 23. The basic body 21, designed to travel through the loom shed in a horizontal position, comprises a lateral wing 24, which is appropriately shaped for protection purposes and which is designed to take up a vertical position.

The fixed member 22 is obtained in one piece with, or is fixed by any known means to the basic body 21 and it may be made of the same material thereof, or of a different material. Preferably, the basic body 21 will be made of highly resisting synthetic plastic material, while the fixed member 22 will be of metal. As can be seen, the end of the member 22 terminates with a hook 25, the surface 26 of which is a variable pitch helical surface.

The movable member 23 consists of a metal toggle lever pivoted about axis 27 to the basic body 21, by means of a pivot 28. The movable member 23 has its end 23', close to the hook 25 of the fixed member 22, formed with a variable pitch helical surface 29, conjugated to the surface 26 of the fixed member: the surfaces 26 and 29 of the two members 22 and 23 are designed to cooperate in the manner specified hereinafter, in order to carry out the gripping of the weft thread to be transported.

The movable member 23 is pushed with its end 29 towards the hook 25 of the fixed member 22, by the action of a flat spring 30, acting at the other end thereof:

said spring 30 is carried by the basic body 21 of the gripper, with possibility of adjustment by means of the screw 31. A plate 32 is parallel to the basic body 21 and fixed thereto by means of screws 33.

The plate 32 may be entirely made of damping material or it may be provided with a damping block in correspondence of its extension 32', contacting the movable member 23, said extension being separated from the remaining part of the plate by a longitudinal slit 32''. The plate 32 also carries a micrometer adjustment screw 34, whose point engages the extension 32', in order to resiliently vary the position thereof. Since, with the gripper in a closed position, the extension 32' of the plate opposes the inner surface of the movable member 23, the above allows one to vary the relative position between the two members 22 and 23, with closed gripper, and hence to appropriately adjust the width of the opening between the two conjugated gripping surfaces 26 and 29, at the ends of the two members.

The particular damping nature of the material forming the plate 32 allows one to absorb any vibrations which may be produced on the movable member, and considerably reduces the impact effect occurring between the movable member 23 and the extension 32' of the plate, when the gripper, after opening for releasing the weft thread, goes back to the original closed position by the action of the spring 30.

The reference 35 indicates a fixed gripper-opener, designed to act on the rear curved part 23'' of the member 23, in order to open the same at its passage before said opener.

By this arrangement, in using the grippers, the movable member 23 places itself close to the fixed member 22, so as to create a slit between the surfaces 26 and 29 (which are normally not in contact, due to the action of the plate extension 32' produced by the screw 34), the width and inclination of said slit, in respect of the horizontal direction, decreasing towards the ends of the members themselves.

In operation, the weft thread is grasped by the hook 25 from the inside of the carrying gripper, inserting itself in the aforementioned slit, between the member 22 and the member 23, where it automatically finds its gripping position, in correpondence of the point where the gripping force determined by the coupling between the members 22 and 23 balances the tension of the thread produced by the feed braking. It so happens that the thicker or less braked yarns are inserted at the start of the slit, while the thinner or more braked yarns take place at the end of the slit. In other words, the end part 29 of the movable member 23 acts as a wedge, which is restrained under the helical surface 26 of the fixed member 22, placed under the hook 25. Once the weft thread has been gripped, the two surfaces can by no means come into contact, since the weft thread is inserted between them. As has been said, the inclination of said wedge, considered in a direction transverse to the movement direction of the grippers, and in respect of the horizontal plane, slowly decreases towards the end of the two member.

The coupling force between the surfaces 26 and 29 is constant and is produced by the tension of the spring 30.

If the weft thread is inserted at the start of the slit between said surfaces, where the inclination of the actual surfaces is more pronounced, the gripping pressure on the thread is relatively modest, since the above wedge has a strong opening angle. In this position will hence be inserted, as already said, the thick or scarcely braked wefts. Whereas, if the weft thread tension is higher, it tends to open the gripper and the thread slides into the slit, between the surfaces 26 and 29, up to reaching an area where the opening angle of the wedge is smaller, whereby, with an equal action by the contrast spring, a higher gripping force may be exerted. It is hence understood that the end of the thread will automatically find its gripping position where the gripping pressure balances the thread tension. Therefore, with a constant load contrast spring one is able to obtain an increasing gripping force, as the distance from the end of the members decreases, taking advantage of the fact that the inclination of the surfaces 26 and 29, between which gripping takes place, varies.

The gripping capacity hence becomes, within wide limits, independent from the braking and from the count of the weft thread. The gripper is thus very versatile and it allows an excellent operation in weaving conditions with alternate insertion of two or more wefts having different counts or brakings.

Since, as has been seen, the gripping force depends on the inclination of the contact surfaces close to the point where the grasped thread has automatically reached its balance position, and is independent from the tension of the spring 10, the operator should not, as a rule, interfere to adjust the tension of the spring, according to the braking and to the count of the weft thread.

Moreover, the friction which is created between the end of the thread and the two gripping surfaces, has a damping effect against any vibrations of the spring and eliminates the danger of failed gripping, through separation of the said surfaces caused by vibrations which, especially at high speeds, are likely to be produced on the spring pressing the movable member against the fixed member.

On the other hand, the presence of the screw 34 for adjusting the closing position of the movable member 23 onto the fixed member 22, allows the opening of the slit between the members to be adjusted according to a range of high count yarns or to a range of low count yarns, while the two gripping surfaces 26 and 29 are prevented from coming into contact and from getting caught one into the other when, in the forward stroke, the thread is not gripped.

The same arrangement dampens the vibrations of the two members and of the spring 30 acting onto the movable member.

In the modification of the gripper embodiment shown in FIGS. 13 to 15, the movable member 23 is still pivoted at 27, with its rear part terminating however — instead of in a tail being directly subjected to the action of the spring 10, as in the gripper of FIG. 1 — in an extension 36, to which is connected, at 37, an articulated curved lever 38, urged by the spring 30 and pivoted, at 39, to a straight lever 40, pivoted at 41. The action of the spring 30 is thus transmitted to the member 23, through an articulated quadrilateral 27, 37, 39, 41, which also determines the opening movement of the member 23, when the curved lever 38 runs into the gripper-opener 35. This solution ensures a perfect gripping of the weft thread throughout insertion, in that, when the levers 38 and 40 come into alignment, the movable member 23 is forced to adhere to the fixed member 22 (FIG. 14).

In this way, the vibrations and possible impacts, to which the gripper may be subjected during insertion, do not produce relative displacements between the movable member 23 and the fixed member 22. For this purpose, the arrangement of FIGS. 13 and 14 comprises a pin 42, which is fixed to the gripper body by means of an eccentric pivot, allowing one to adjust its distance in respect of the quadrilateral 27, 37, 39, 41, and a square extension 43 of the lever 40, adapted to bear on the pin 42 when the gripper is in a closed position. A unilateral bond (adjustable in position) is thus created for the quadrilateral, so as to obtain the aforespecified alignment of the levers.

At the end of the insertion, when the gripper gets close to one end of the fabric, the gripper-opener 35 acts on the curved lever 38 and changes the configuration of the quadrilateral 27, 37, 39, 41, from the shape of FIG. 14, to that of FIG. 15. The levers 38 and 49 hence shifted from the aligned position (FIG. 14) to the position forming an angle, and the extension 36 of the member 23 is caused to rotate, thus allowing the opening of the gripper (FIG. 15).

The above described embodiment, in addition to ensuring a perfect and constant gripping during the insertions — which is particularly significant in the case of very thin weft yarns — also provides the considerable advantage of requiring a spring 30, acting with a spring load which is far lower than that of the spring provided for the previously described embodiment. This also provides the advantage of being able to use, in the gripper-opener 35, lower freeing pressures on the lever 38, with consequent minor friction and wear. The result is also a smaller percentage of weft losses at the outlet of the shed, with the loom working at high speeds.

In the embodiment of FIGS. 16 to 20, one obtains the control of the movable member 23, during insertion, by means of an appropriately shaped sector 44, oscillating about a pivot 44' emerging from the gripper body, which sector inserts itself into an opening 45 of the curved tail 46 of the movable member 23.

The sector 44 is pressed against the movable member 23 by a spiral spring 47, having one end tied to the pivot 44' and the opposite end fixed to said sector. The spring 47 is pre-loaded so as to create a torque acting on the sector 44.

The sector 44, free to rotate about the pivot 44', has a cam surface eccentric to said pivot, so that, when the sector is caused to rotate, the distance between said sector and the end 48 of the opening 45 may vary.

Figure 18:
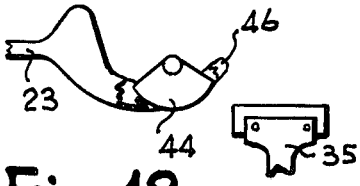
FIGS. 18, 19 and 20 are other detailed views, designed to show more clearly the characteristics and the operation of the gripper of FIG. 16.

In a closed position of the gripper, said distance is automatically annulled by the action of the spiral spring 47, and the contact between the point 48 of the curved tail 46 of the claw 23 and the sector 44, determines the working position of the movable claw, as shown in FIG. 18. In such conditions, one obviously has the same advantages of regularity and weft gripping safety, which have already been pointed out in connection with the solution of FIGS. 13 to 15.

Figure 19:
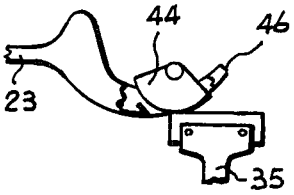
Figure 20:
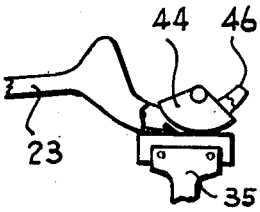

The opening of the gripper by the gripper-opener 35 takes place in two stages: in the first stage, the gripper-opener 35 acts on the sector 44 and causes its rotation, as shown in FIG. 19: in this way, the engagement between the sector 44 and the movable member 23 is eliminated; in the second stage, the gripper arranges itself so that the gripper-opener 35 may act simultaneously on the sector 44 and on the part of the movable member corresponding to the intermediate area of the opening 45, hence causing the opening of the gripper and the freeing of the thread. Once the action of the gripper-opener has come to an end, the gripper closes due to the combined effect of the elastic return of the movable member, subject to the action of the flat spring 30, and of the elastic return of the sector 44, subject to the action of the spiral spring 47.

I claim:

1. A drawing gripper for gripping and transporting weft yarns in continuous weft feed looms, from a point at the center of the shed and to draw the yarn out of the shed, comprising a support, a fixed member secured to said support, a movable member mounted on said support for oscillation toward and away from the fixed member in a horizontal plane about a vertical axis, said fixed member terminating in a hook disposed in a vertical plane, an end of said movable member swinging horizontally in and out of said hook, and spring means urging said end into said hook, said end of said movable member having an upper surface and the inside of said hook having a lower surface, said surfaces coacting releasably to grasp said yarn between them, said surfaces being conjugated helical surfaces of variable pitch that decrease both in distance from each other and in inclination to the horizontal in a direction toward the end of said movable member.

2. A gripper as in claim 1, in which said movable member is a toggle lever pivoted at an intermediate point on said support, said spring means acting on the end of said movable member opposite said hook.

3. A gripper as in claim 1, in which the pivotal axis of the movable member is a pivot carried by a plate fixed to said support, said plate having a resilient extension engageable with the movable member in a closed position of said movable member relative to said fixed member, and micrometer screw means carried by said support and bearing on said extension for adjustment of the position of said movable member.

* * * * *